US006677293B1

(12) United States Patent
Allgaier et al.

(10) Patent No.: US 6,677,293 B1
(45) Date of Patent: Jan. 13, 2004

(54) METHOD FOR INCREASING THE EFFICIENCY OF SURFACTANTS WITH SIMULTANEOUS SUPPRESSION OF LAMELLAR MESOPHASES AND SURFACTANTS WITH AN ADDITIVE ADDED THERETO

(75) Inventors: Jürgen Allgaier, Aachen (DE); Lutz Willner, Jülich (DE); Dieter Richter, Jülich (DE); Britta Jakobs, Langenfeld (DE); Thomas Sottmann, Cologne (DE)

(73) Assignee: Forschungszentrum Jülich GmbH (DE)

( * ) Notice: Subject to any disclaimer, the term of this patent is extended or adjusted under 35 U.S.C. 154(b) by 0 days.

(21) Appl. No.: 09/763,413

(22) PCT Filed: Aug. 26, 1999

(86) PCT No.: PCT/DE99/02748

§ 371 (c)(1),
(2), (4) Date: Jun. 11, 2001

(87) PCT Pub. No.: WO00/12660

PCT Pub. Date: Mar. 9, 2000

(30) Foreign Application Priority Data

Aug. 28, 1998 (DE) ..... 198 39 054

(51) Int. Cl.[7] ..... C11D 3/37

(52) U.S. Cl. ..... 510/417; 510/405; 510/416; 510/418; 510/475; 424/406; 424/408

(58) Field of Search ..... 424/406, 408; 510/475, 455, 416, 417, 418

(56) References Cited

U.S. PATENT DOCUMENTS

| | | | | |
|---|---|---|---|---|
| 4,266,610 A | | 5/1981 | Meister | 166/273 |
| 4,302,558 A | * | 11/1981 | Ohya et al. | 525/218 |
| 4,384,974 A | | 5/1983 | Guthauser | 252/309 |
| 5,294,658 A | | 3/1994 | Scholz et al. | 524/457 |
| 5,518,648 A | | 5/1996 | Welch et al. | 252/174.22 |
| 5,962,003 A | * | 10/1999 | Shukla et al. | 424/406 |

FOREIGN PATENT DOCUMENTS

| | | |
|---|---|---|
| DE | 1963477 | 12/1997 |
| EP | 0481717 | 4/1992 |
| EP | 870 781 | 10/1998 |
| GB | 1103201 | 2/1968 |
| GB | 2223235 | 4/1990 |

* cited by examiner

*Primary Examiner*—Gregory E. Webb
(74) *Attorney, Agent, or Firm*—Connolly Bove Lodge & Hutz LLP

(57) ABSTRACT

The invention relates to a method for increasing the efficiency of surfactants and to a method for suppressing lamellar mesophases in microemulsions. Additive block co-polymers with a water-soluble block A and a water-insoluble part B are added to the surfactants. The efficiency of surfactants can be in-creased to a substantial extent by using said compounds as additives. The formation of undesirable lamellar mesophases in microemulsions is suppressed by adding said block co-polymers.

17 Claims, 14 Drawing Sheets

Figur 10

Figure 1:
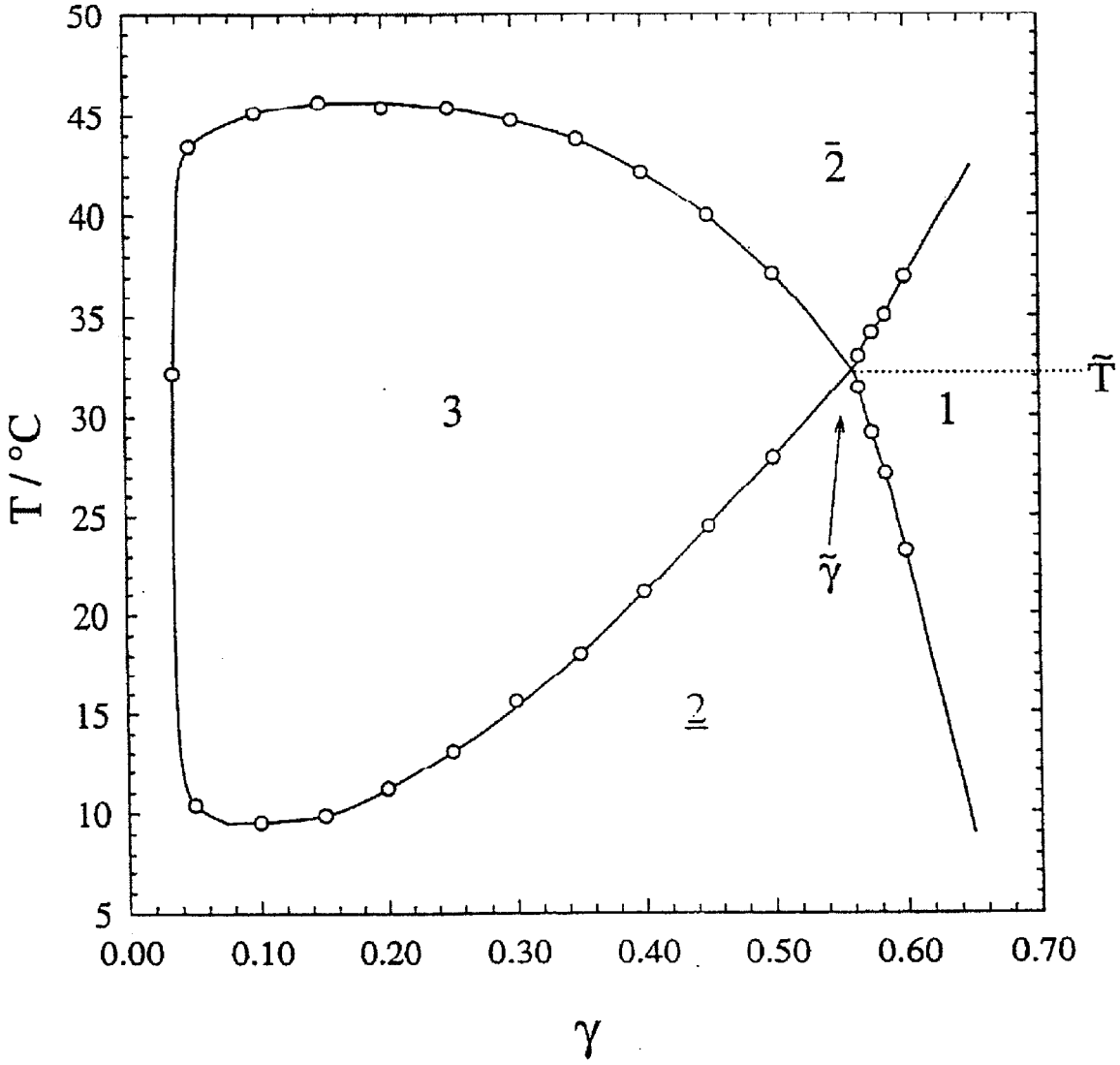

METHOD FOR INCREASING THE EFFICIENCY OF SURFACTANTS WITH SIMULTANEOUS SUPPRESSION OF LAMELLAR MESOPHASES AND SURFACTANTS WITH AN ADDITIVE ADDED THERETO

The invention relates to a method for increasing the efficiency of surfactants with concur-rent suppression of lamellar mesophases, particularly in microemulsions and emulsions, as well as to surfactants with an additive admixed thereto.

According to the state of the art, emulsions and microemulsions are stabilized by non-ionic, anionic or cationic surfactants. The surfactants are capable of solubilizing a non-polar solvent (oil) in a polar solvent (for example, water). The efficiency of the surfactants is expressed by the amount of surfactant that is needed to solubilize a certain portion of oil in water or vice versa. Moreover, in the case of water-oil-surfactant mixtures, a distinction is made between emulsions and microemulsions. Whereas microemulsions are thermodynamically stable, emulsions are thermodynamically unstable and they disintegrate. On the microscopic level, this difference is reflected by the fact that the emulsified liquids in microemulsions are expressed in terms of smaller liquid volumes (for instance, $10^{-15}$ $\mu$L) than in emulsions (for instance, $10^{-12}$ $\mu$L). Therefore, thermodynamically un-stable emulsions exhibit larger structures.

Lamellar mesophases can occur in microemulsion systems. Lamellar mesophases cause optical anisotropy and increased viscosity. These properties are undesirable, for example, in detergents, because the lamellar mesophases cannot be washed out. Moreover, additives generally influence the temperature behavior of emulsions and microemulsions. For instance, a shift of the monophase areas for oil-water-surfactant mixtures to other temperature ranges can be observed in the phase diagram when an additive is admixed. These shifts can be in the order of magnitude of 10° C. [18° F.]. This, however, makes it necessary, for example, to change the detergent formulations in order to adapt them to the new temperature behavior that prevails in the monophase area. In addition, while saving on surfactants, there is a need to achieve an emulsifying behavior that is at least as good and to reduce the interfacial surface tension, which translates into an improvement of the washing power of detergents, for example.

Consequently, the objective of the invention is to raise the efficiency of surfactants and to reduce even further the interfacial surface tension between water and oil in the presence of surfactants. Furthermore, the occurrence of lamellar phases in microemulsions or water-oil-surfactant mixtures is to be suppressed. The temperature behavior of the emulsions and microemulsions is to remain unaffected by the admixture of the additive, that is to say, the admixture of the additives should not have very much influence on the position of the monophase area in the phase diagram in terms of the temperature. An additive is to be created that does not impact upon the position of the monophase area in terms of the temperature. An additive is also to be created that has the above-mentioned advantages and that can be admixed, for example, to a detergent, without the need to change the formulation of the remaining detergent formulation. The possibility is to be created to prepare microemulsions in which the size of the emulsified liquid particles corresponds to that of emulsions.

Surprisingly, based on the generic part of claim 1, all of these objectives are achieved according to the invention in that a block copolymer having a water-soluble block A and a water-insoluble block B is used as the additive.

According to the invention, the addition of the AB block copolymer to the water-oil-surfactant mixture does not change the monophase area in the phase diagram in terms of the temperature; the efficiency of the surfactant mixture is considerably increased, lamellar mesophases are suppressed in microemulsions and the interfacial surface tension between water and oil is reduced to a greater extent than with the surfactants alone. Moreover, microemulsions retain their characteristic properties while their structure size is increased; for instance, the emulsified structures acquire sizes of up to approximately 2000 Å. This gives rise to a microemulsion that has the structural sizes of an emulsion but that is thermodynamically stable. The size of the emulsified liquid particles depends on the temperature and on the amount of block copolymer added, and thus on the composition of the surfactant mixture.

Advantageous embodiments of the invention ensue from the subordinate claims.

Blocks A and B can have molecular weights between 500 u and 60,000 u. Preference is given to the use of a polyethylene oxide (PEO) block as block A However, it is possible to employ all blocks A that are water-soluble, so that, together with block B, they form an amphiphile. Other examples of block A are polyacrylic acid, polymethacrylic acid, poly-styrene sulfonic acid as well as their alkali-metal salts in which the acid function has been at least partially substituted by alkali-metal cations, polyvinyl pyridine and polyvinyl alcohol, polymethyl vinyl ether, polyvinyl pyrrolidine, polysaccharides as well as mixtures thereof.

Various water-insoluble components with the above-mentioned molecular weight can be used as block B. Thus, for instance, block B can be the product of an anionic 1,2-polymerization, 3,4-polymerization or 1,4-polymerization of dienes. Consequently, block B can also be the product of an at least partial hydration of polydienes. Examples of typically used monomeric components are 1,3-butadiene, isoprene, all of the constituents *) of dimethyl butadiene, 1,3-pentadiene, 2,4-hexadienes, α-methyl styrene, isobutylene, ethylene, propylene, styrene or alkyl acrylates and alkyl methacrylates, whereby the alkyl group contains between 2 and 20 carbon atoms. Block B can also be polydimethyl siloxane. The polymer of a single monomer or of a monomer mixture can be employed as block B.

Translator's note: the German original uses the word "Konstitumere", which apparently does not exist since it is not to be found in reference works for the German language (the English "equivalent" would be "constitumers"), but perhaps the author meant something along the lines of "constituents". Block B can have methyl, ethyl, vinyl, phenyl or benzyl groups as side chains.

The double bonds in the polydiene chain as well as in the vinyl groups, which can be pre-sent as a side chain, can be either totally or partially hydrated. According to the invention, however, any sufficiently amphiphilic block copolymer can be used. The AB block co-polymers used according to the invention are preferably obtained by means of anionic polymerization.

If blocks A and B have low molecular weights in the order of magnitude of about 500 to 5000 g/mol, particularly advantageous properties of the AB block copolymers according to the invention can be observed in the application products. For instance, the polymers with such low molecular weights dissolve rapidly and thoroughly. This is true, for example, of solutions in soaps and detergents.

In the AB block copolymers employed according to the invention, the two blocks A and B should have the largest possible difference in their polarity. In this context, block A should preferably be polar and block B preferably nonpolar.

This increases the amphiphilic behavior. Block A should be water-soluble and block B should be soluble in non-polar media. Advantageously, block B should be soluble in mineral oils or aliphatic hydrocarbons or else soluble in mineral oils and aliphatic hydrocarbons. This also applies at room temperature.

Furthermore, it is also possible to employ AB block copolymers of the types ABA and BAB, which are designated as triblock copolymers.

For example, the following surfactants (C) and their mixtures can be used with the additives according to the invention:

non-ionic surfactants of the class of alkyl polyglycol ethers ($C_iE_j$) wherein i≧8 (C=carbon atoms in the alkyl chain, E=ethylene oxide units);

non-ionic surfactants of the class of alkyl polyglucosides (APG) "sugar surfactants", $C_iG_j$ wherein i≧8 with alcohol as a co-surfactant ($C_x$—OH, x≧6);

anionic surfactants, for example, AOT (sodium bis-(2-ethyl hexyl)-sulfosuccinate);

cationic surfactants surfactant mixtures industrial surfactants

A few terms and expressions will be explained below:

C=any desired surfactant, such as anionic, cationic, non-ionic surfactant or sugar surfactant as well as their mixtures containing at least two surfactants D=additive that, according to the invention, is admixed to the surfactant C γ=total surfactant concentration (weight fraction) consisting of C and D, wherein $$\gamma = \frac{m(C) + m(D)}{m_{total}}$$

wherein m=weight in g

γ=dimensionless weight fraction $m_{total}$=weight consisting of $m_{water}$=$m_{oil}$+m(C)+m(D)

$\bar{\gamma}$=total surfactant concentration at the point of intersection at which the monophase area meets the tri-phase area in the phase diagram. At the given water-to-oil ratio, this corresponds at least to the total surfactant concentration needed for complete solubilization of water and oil δ=weight fraction of additive D in the mixture consisting of surfactant C+additive D, corresponding to $$\delta = \frac{m(D)}{m(C) + m(D)}$$

wherein m=weight in g and

δ=weight fraction (dimensionless)

The invention will be illustrated below with reference to an example. PX/Y=additive with a molecular weight in [sic] 1000 g/mol of X of*) a hydrophobic alkyl chain (hydrated 1,4-polyisoprene) and a molecular weight in 1000 g/mol of Y of polyethylene oxide.

Translator's note: there seems to be something wrong with the prepositions used in this sentence in German, starting with "having a molecular weight in 1000 g/mol" instead of "having a molecular weight of 1000 g/mol" and then also in "1000 g/mol of X of hydrophobic alkyl chain" and in "1000 g/mol of Y of polyethylene oxide" (the German preposition used here could also be translated as "on", but although "1000 g/mol of X on the hydrophobic allyl chain" might be seen as okay, "Y on polyethylene oxide" sounds odd).

Example P5/5: the alkyl chain has a molecular weight of 5000 g/mol (=u) and the poly-ethylene oxide chain has a molecular weight of 5000 g/mol.

P22/15: the alkyl chain has a molecular weight of 22,000 g/mol and the polyethylene oxide chain has a molecular weight of 15,000 g/mol.

The additives thus prepared are AB block copolymers.

The compounds shown here as examples can be obtained employing the preparation method described in DE 196 34 477 A1.

Figure 2:
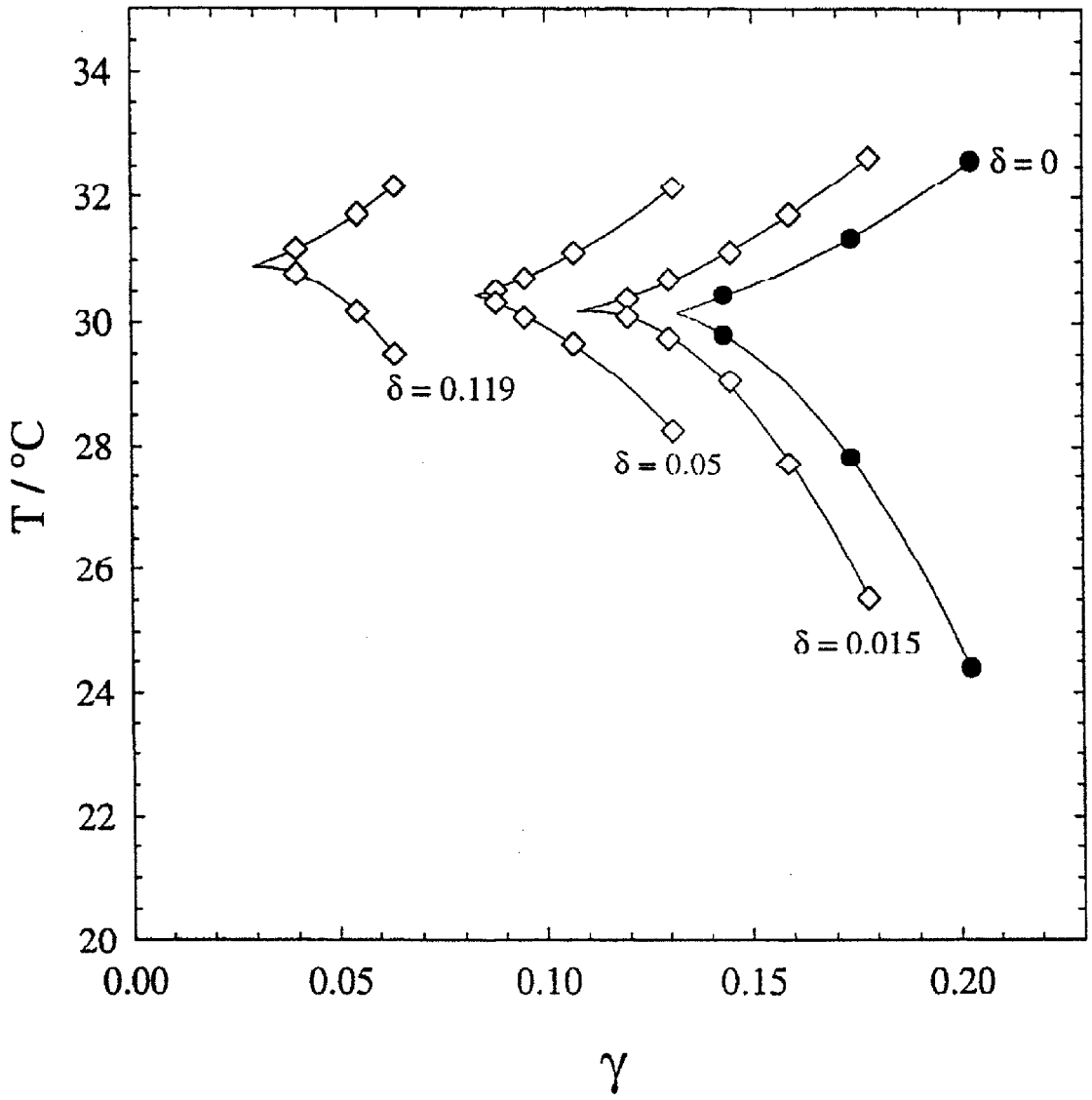
Figure 3:
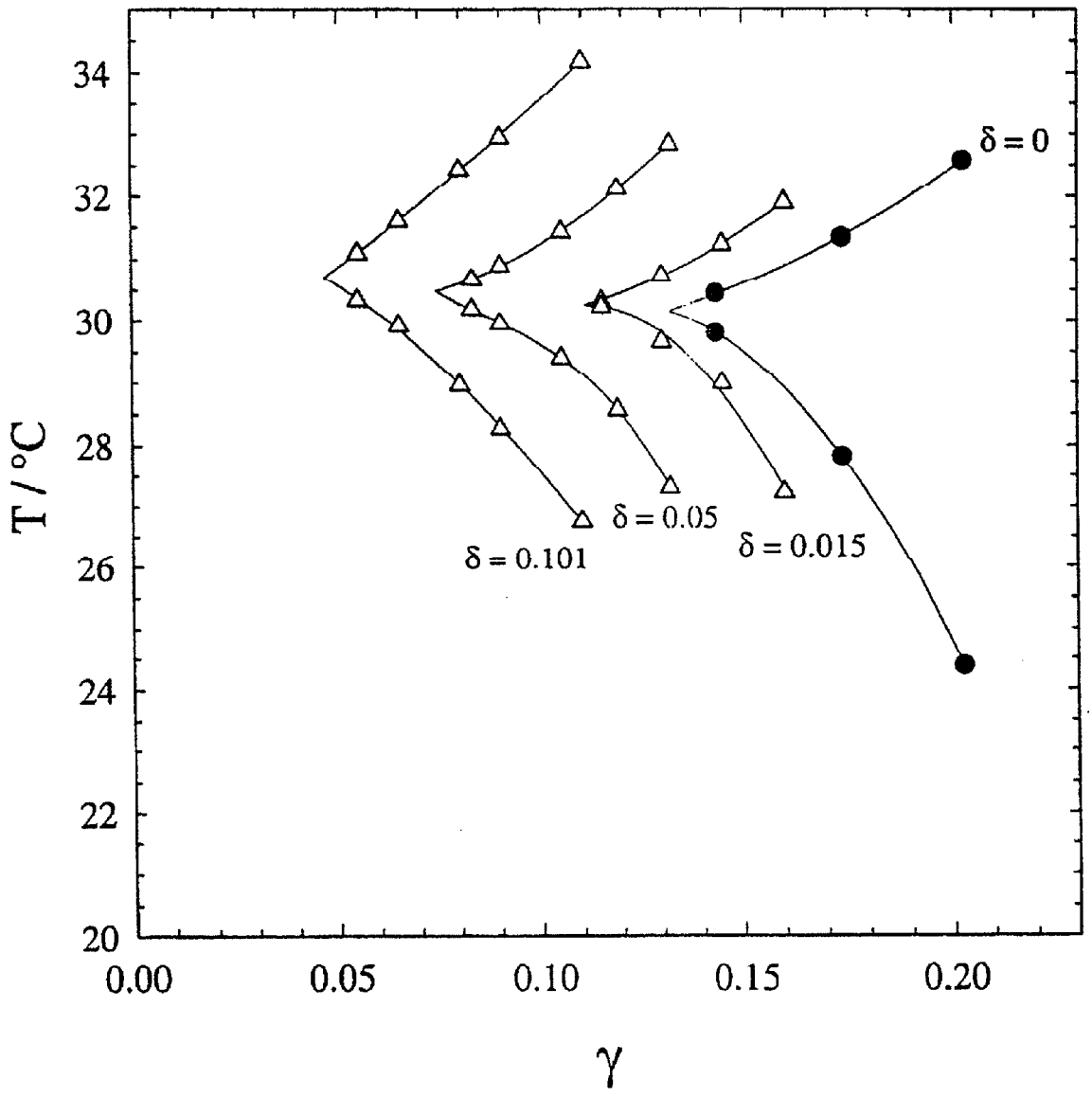
Figure 4:
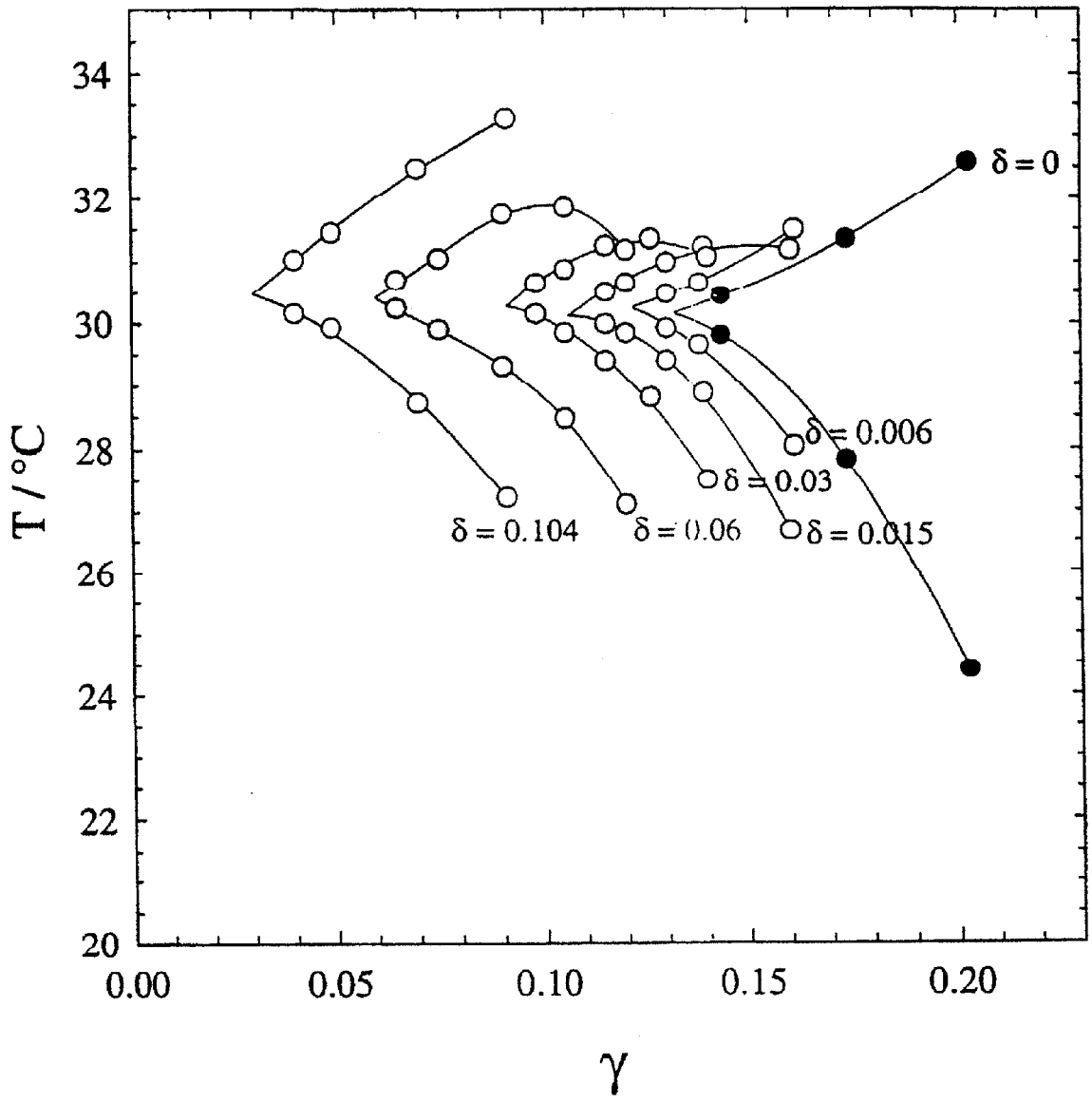
Figure 5:
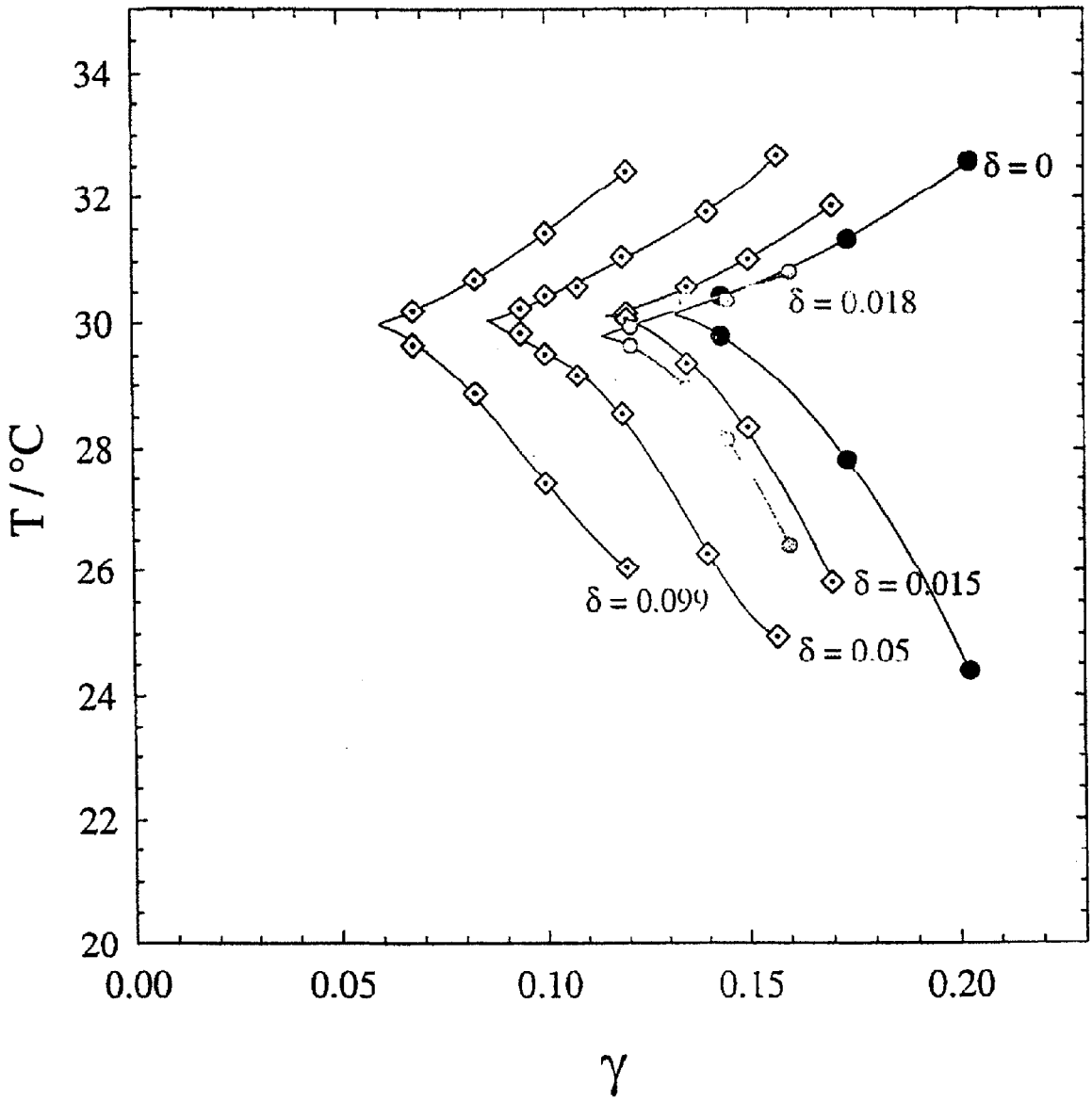
Figure 6:
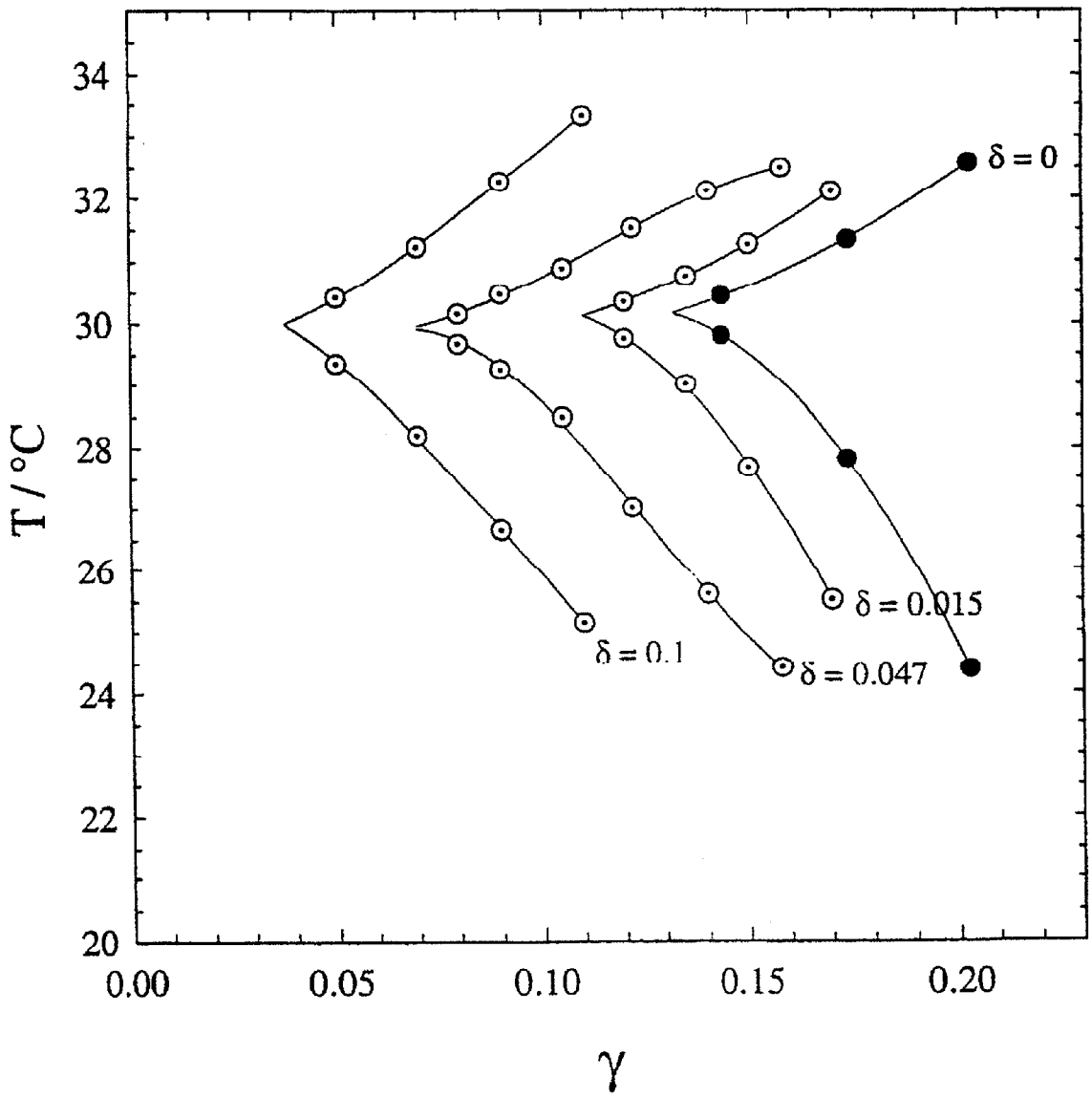
Figure 7:
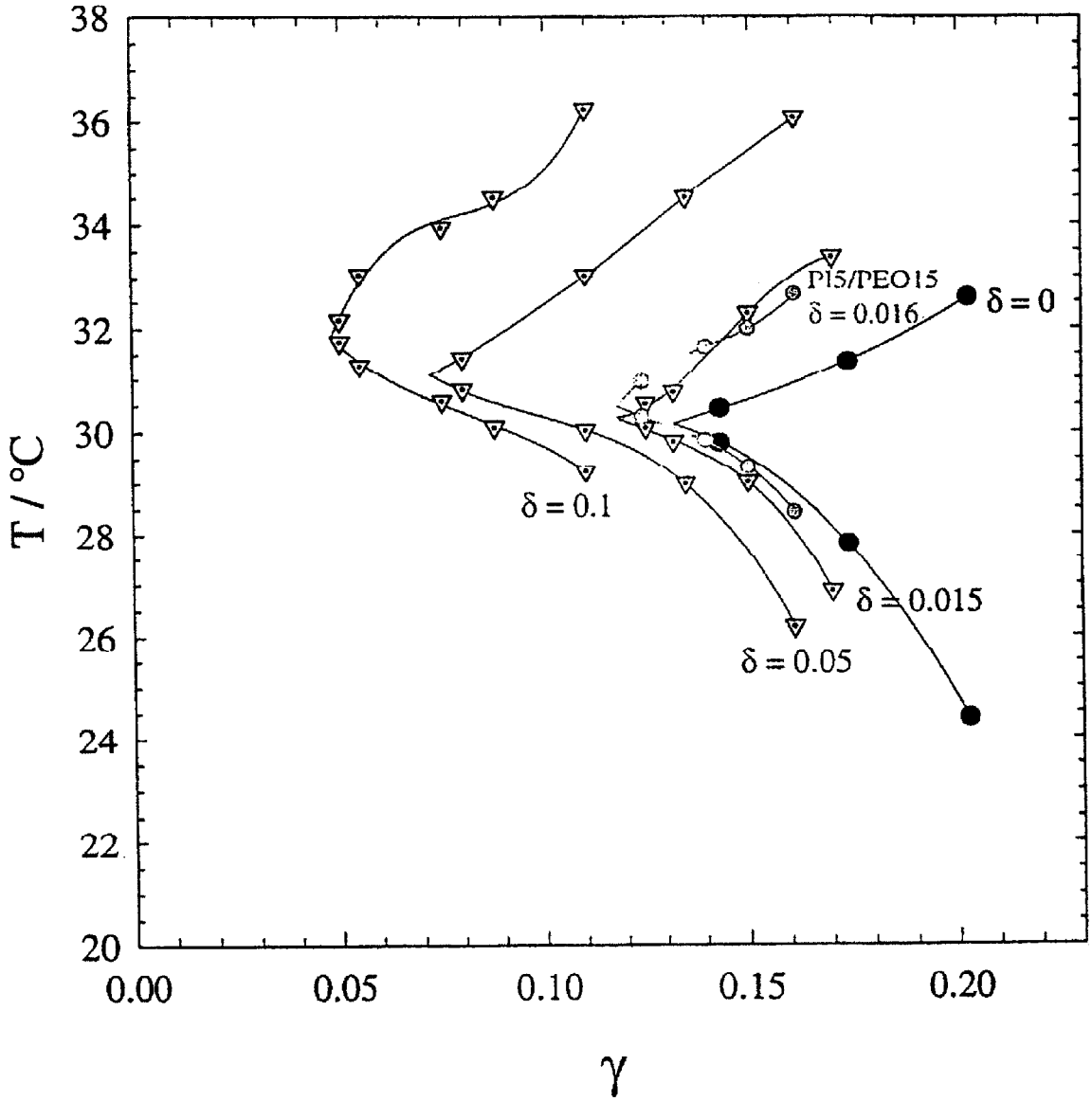
Figure 8:
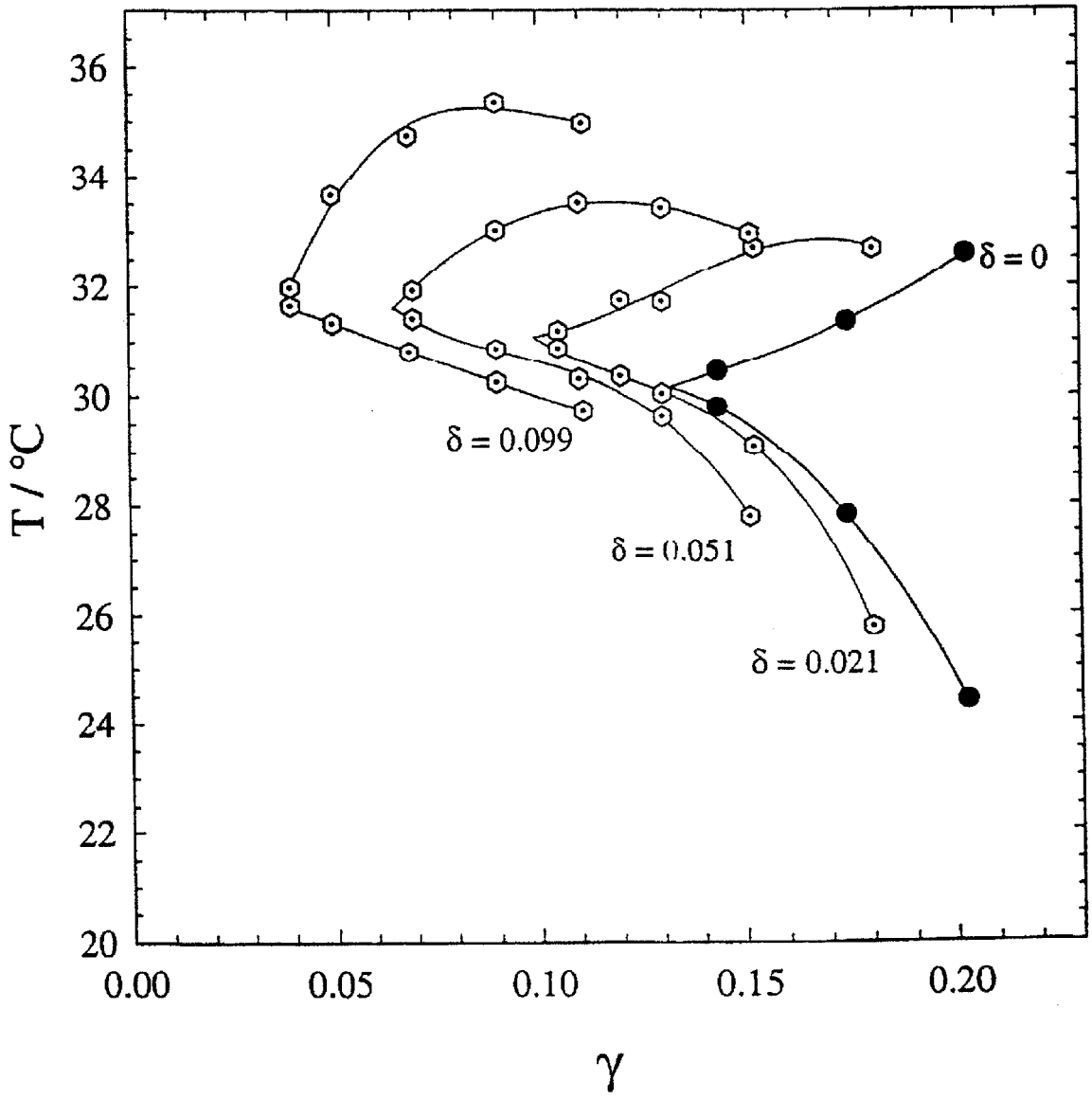
Figure 9:
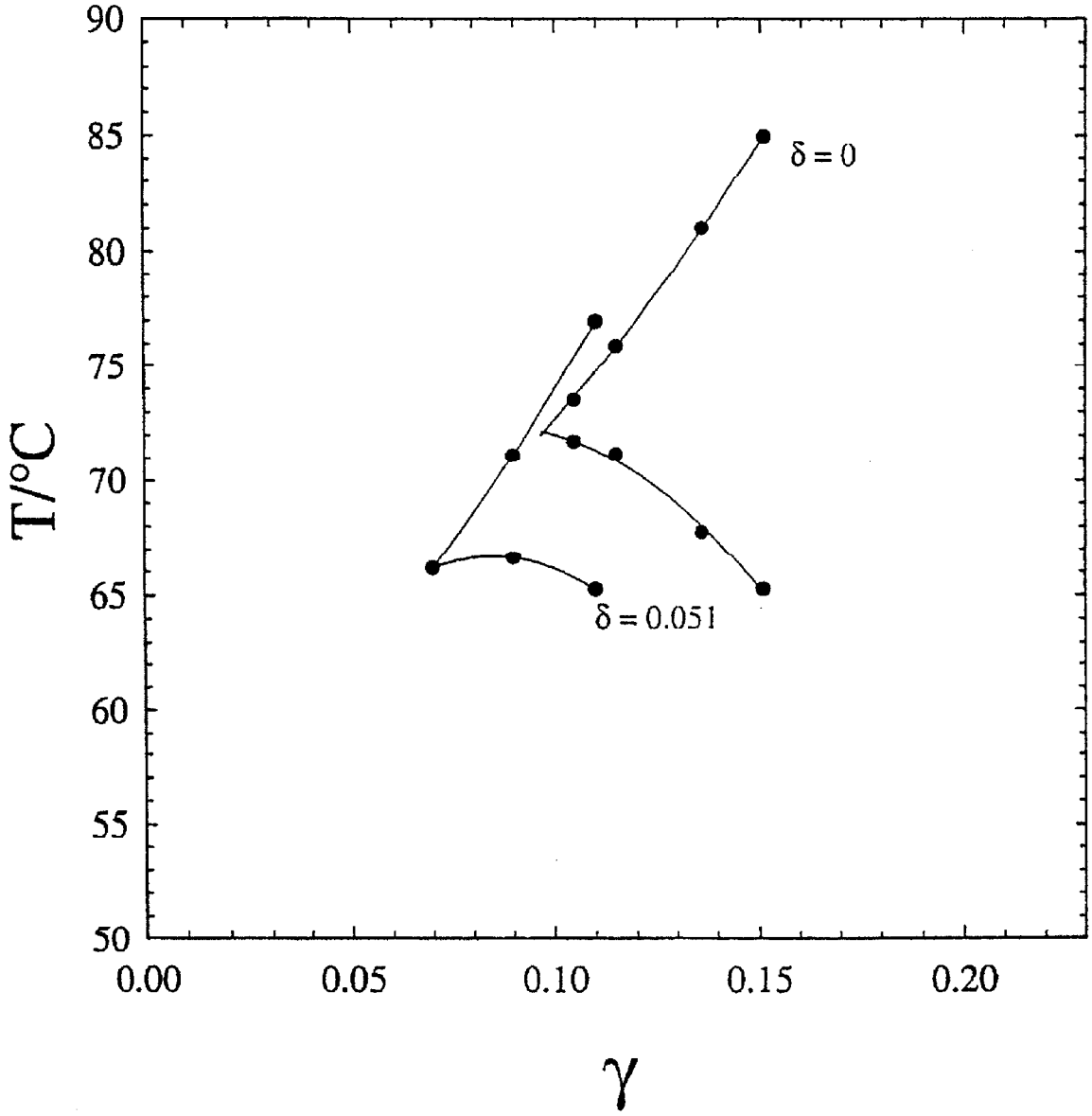
Figure 10:
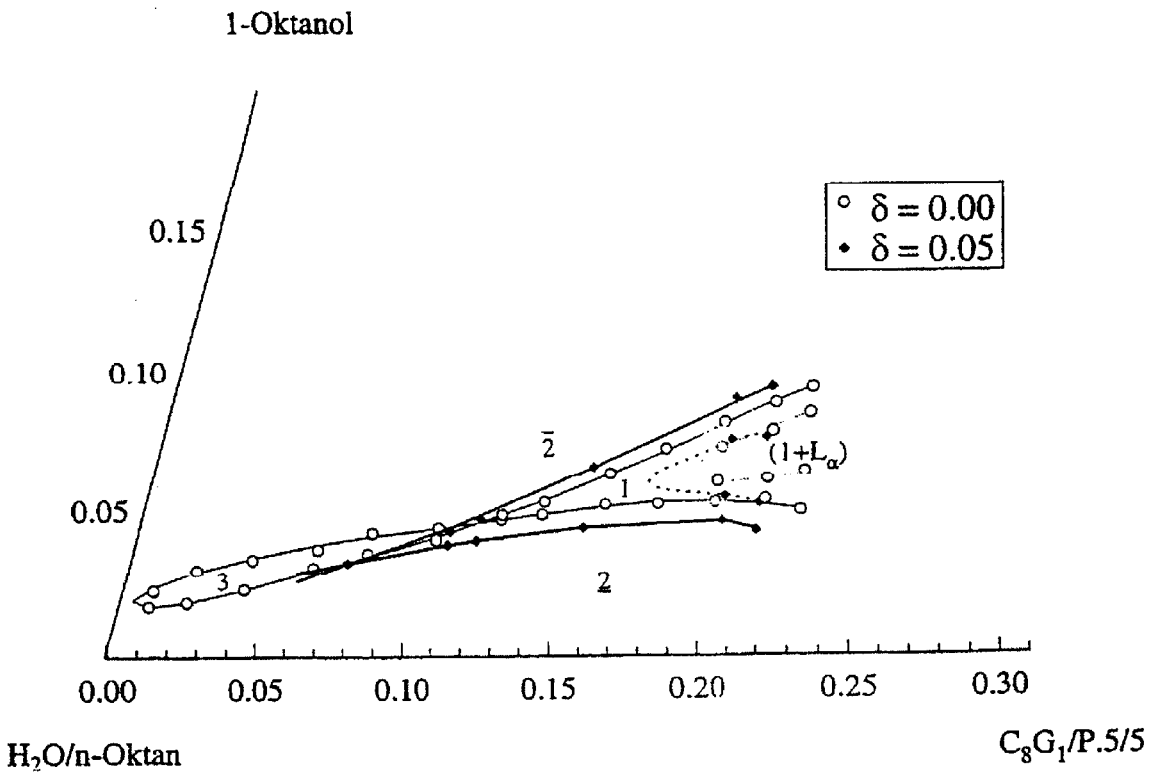

The behavior of the microemulsions according to the invention is depicted in the figures, whereby the following is shown:

FIG. 1: typical temperature-surfactant-concentration section through the phase prism at a constant water-to-oil ratio for the system consisting of $H_2O$ and tetradecane-$C_6E_2$ for comparison purposes;

FIG. 2: the monophase areas for the mixture consisting of water and n-decane-$C_{10}E_4$-P5/5 as a function of the addition of P5/5 (δ) in a temperature-surfactant-concentration diagram;

FIG. 3: the monophase areas for the mixture consisting of water and n-decane-$C_{10}E_4$-P10/10 as a function of the addition of P10/10 (δ) in a temperature-surfactant-concentration diagram;

FIG. 4: the monophase areas for the mixture consisting of water and n-decane-$C_{10}E_4$-P22/22 as a function of the addition of P22/22 (δ) in a temperature-surfactant-concentration diagram;

FIG. 5: the monophase areas for the mixture consisting of water and n-decane-$C_{10}E_4$-P5/3 as a function of the addition of P5/3 (δ) and P 5/2 (δ) in a temperature-surfactant-concentration diagram;

FIG. 6: the monophase areas for the mixture consisting of water and n-decane-$C_{10}E_4$-P22/15 as a function of the addition of P22/15 (δ) in a temperature-surfactant-concentration diagram;

FIG. 7: the monophase areas for the mixture consisting of water and n-decane-$C_{10}E_4$-P5/15, and the mixture consisting of water and n-decane-$C_{10}E_4$-PI5/PEO15 (PI5=poly-isoprene with a molecular weight of 5000 g/mol, PEO15=polyethylene oxide with a molecular weight of 15,000 g/mol (AB-block copolymer)) as a function of the addition of (δ) in a temperature-surfactant-concentration diagram;

FIG. 8: the monophase areas for the mixture consisting of water and n-decane-$C_{10}E_4$-P5/30 as a function of the addition of P5/30 (δ) in a temperature-surfactant-concentration diagram;

FIG. 9: the monophase areas for the mixture consisting of (water +NaCl) and n-decane-AOT-P5/5 as a function of the addition of P5/5 (δ) in a temperature-surfactant-concentration diagram;

FIG. 10: the monophase areas for the mixture consisting of water and n-decane-$C_8G_1$-P5/5 ($C_8G_1$=n-octyl-β-D-glucopyranoside, which is a sugar surfactant) as a function of the addition of P5/5 (δ) in a tetrahedron section at a constant water-to-oil ratio and at T=25° C. [77° F.]. In this context, $C_8G_1$ is a sugar amphiphile.

Figure 11:
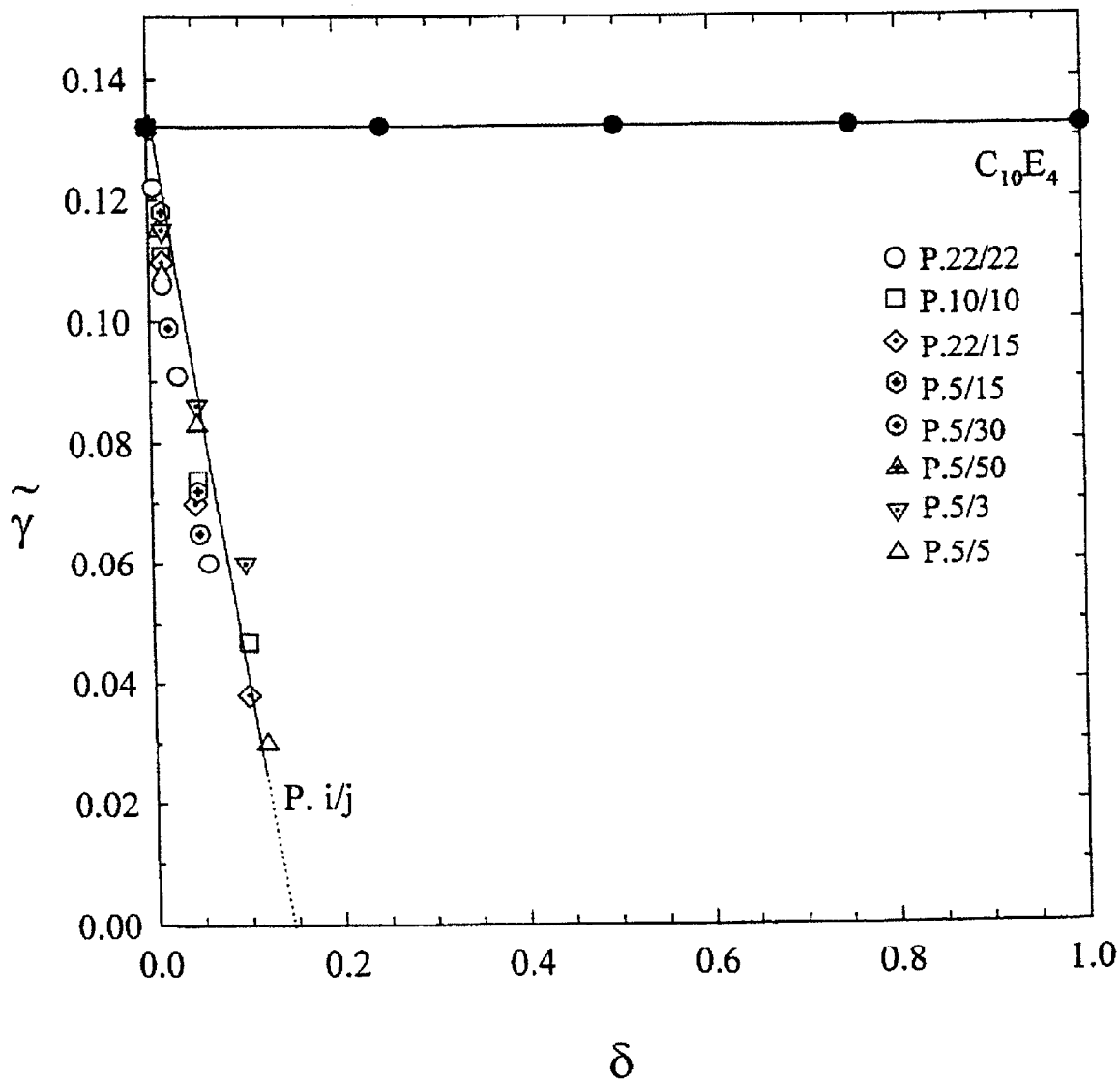

FIG. 11: overview: $\bar{\gamma}$ as a function of δ for the various systems consisting of water and n-decane-$C_{10}E_4$-Px/y.

Figure 12:
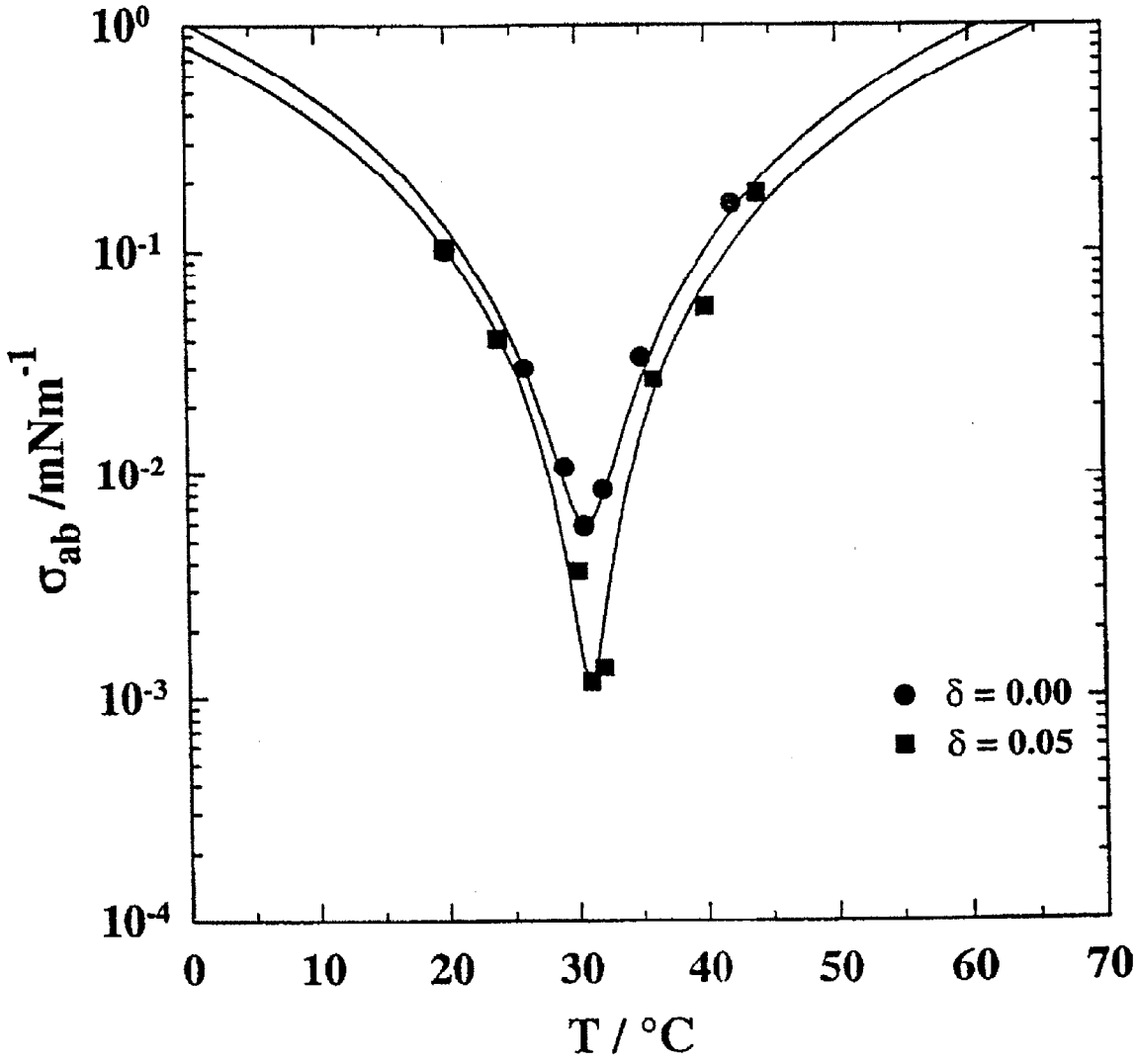

FIG. 12: oil-water interfacial surface tension as a function of the temperature for the mixture consisting of water and n-decane-$C_{10}E_4$-P5/5 for δ=0 and a δ=0.05.

Figure 13:
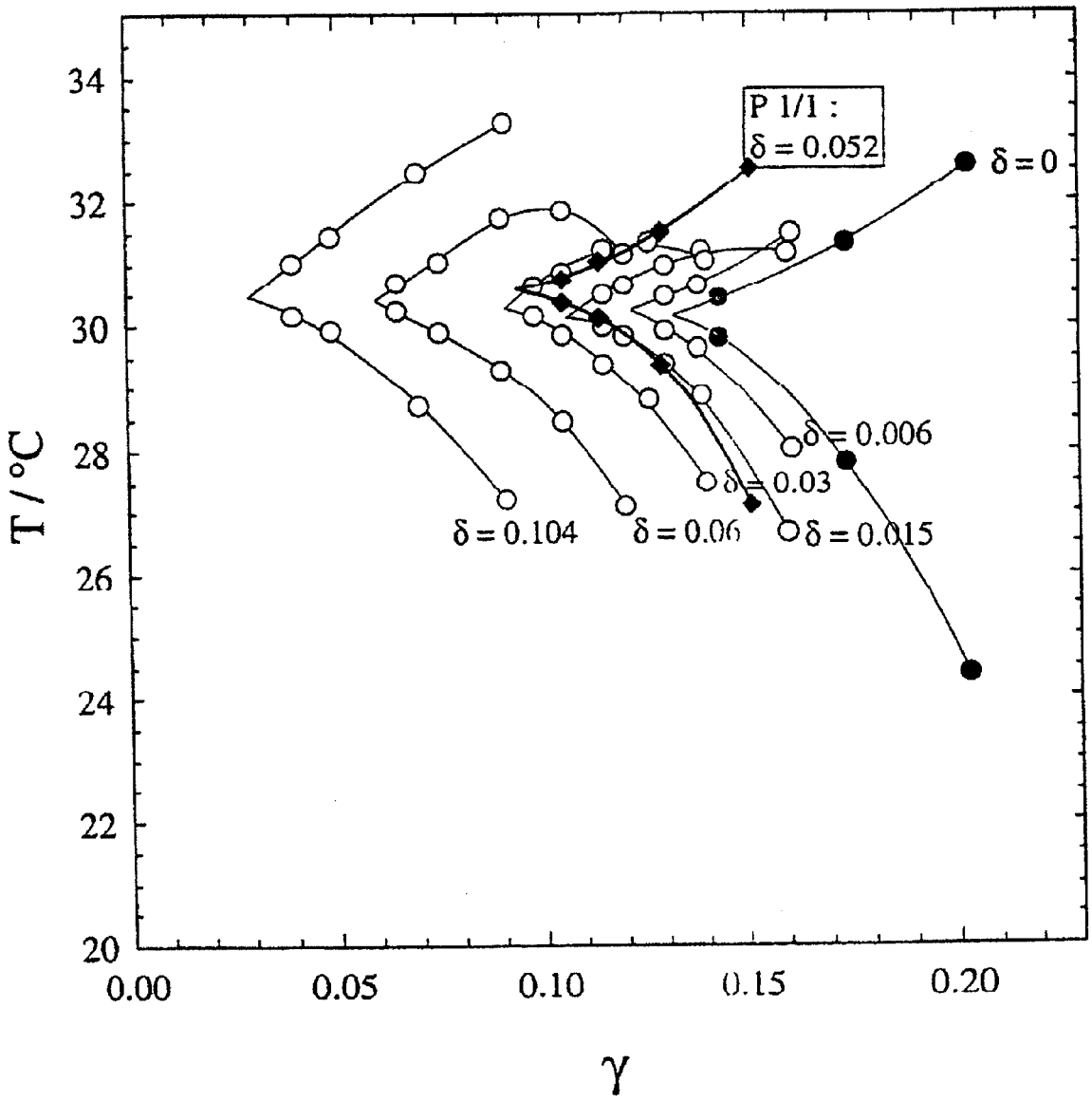
Figure 14:
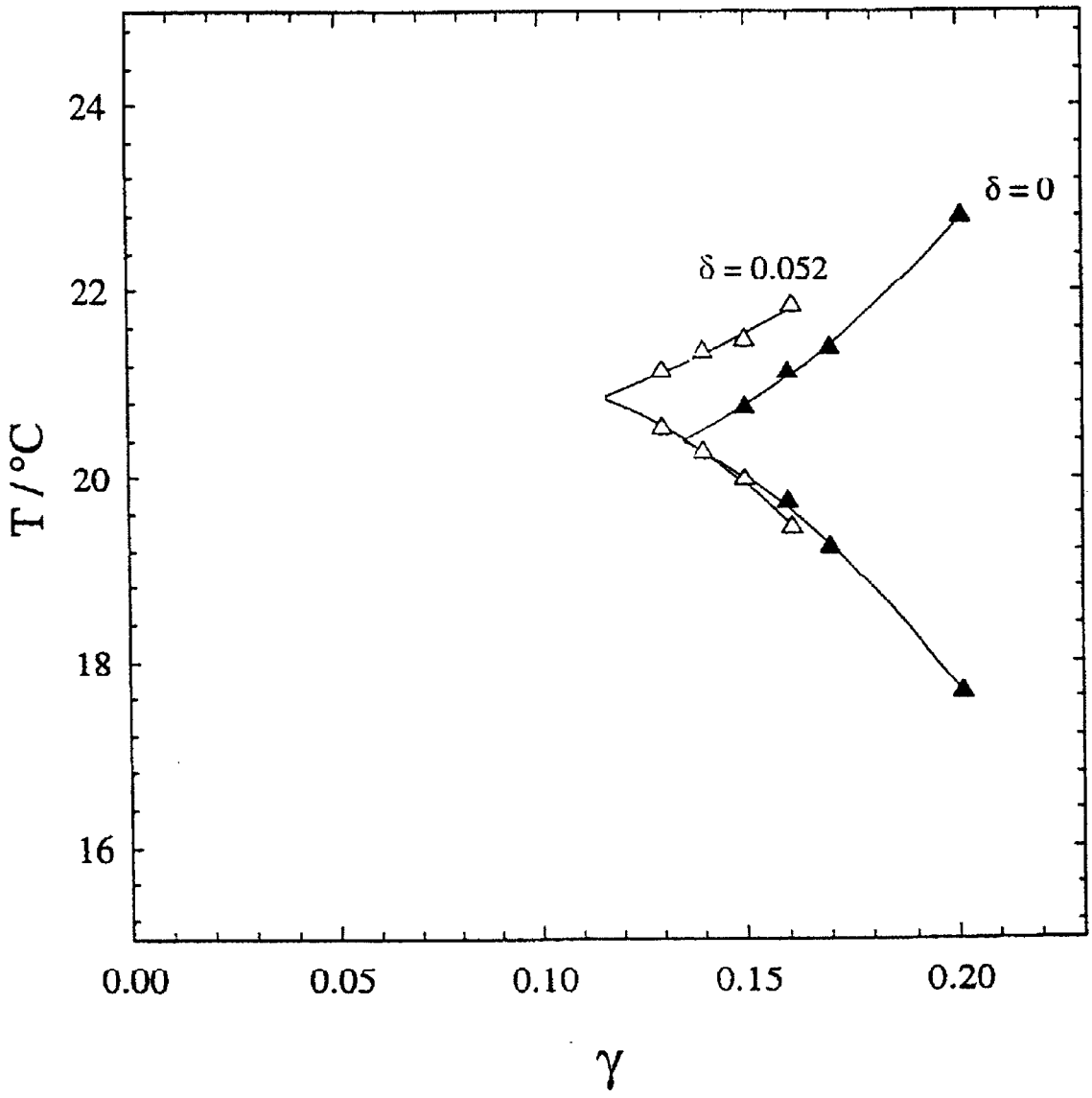

FIG. 13: monophase areas for the systems consisting of $H_2O$ and n-decane-$C_{10}E_4$-P22/22 (empty circles) as well as of $H_2O$ and n-decane-$C_{10}E_4$-P1/1 (black diamonds) as a function of δ;

FIG. 14: monophase areas for the systems consisting of $H_2O$ and n-decane-$C_8E_4$-PS1/PEO1 (PS1=polystyrene with a molecular weight of 1000 g/mol, PEO1=poly-ethylene oxide with a molecular weight of 1000 g/mol; (AB-block copolymer)) in a temperature-surfactant-concentration diagram. The $H_2O$-cyclohexane ratio is 1:1.

The ratio of $H_2O$ to n-decane achieved in FIGS. 1 through 9 and 11 through 13 is 1:1.

FIG. 1 shows the type of phase diagram according to the state of the art that serves as the basis for FIGS. 1 through 8. Here, the temperature T has been plotted against the total surfactant concentration $\gamma$ for the system consisting of water and n-tetradecane-$C_6E_2$ and a ratio of water to n-tetradecane of 1:1.

The monophase area 1 of the mixture is found at higher surfactant concentrations. This area is immediately followed by a closed three-phase area 3 in the direction of lower surfactant concentrations. Two-phase areas 2 are located above and below the phase boundary lines. The point at which all phase areas converge is defined by the surfactant concentration $\overline{T}$ and by the temperature $\overline{\Gamma}$. The more $\overline{\gamma}$ is shifted towards smaller values, the larger the structural size of the microemulsions.

The T/$\gamma$diagrams shown in FIGS. 2 through 9 refer to systems at a constant water-to-oil volume ratio of 1:1 and will be generally elucidated below.

The curves at each specific value $\delta$ that characterizes the delimitation of the appertaining monophase area belonging to a $\delta$ value are drawn in these diagrams. The peak of each curve is the point at which various multiphase areas converge. The more the peak of a curve is situated at lower surfactant concentrations, that is to say, $\gamma$ values, the greater the efficiency of the surfactant C due to the addition of the block copolymer D.

FIG. 2 shows how the efficiency of the total surfactant increases with the addition of the block copolymer. Moreover, no substantial shift of the monophase area on the temperature axis can be observed. This means that the block copolymer D leaves the status of the efficiency of surfactant C largely unchanged with respect to its application temperature. Furthermore, no lamellar mesophases occur in the examined mixtures.

The same characteristics, both in terms of the efficiency and the temperature behavior, occur in FIG. 3.

The efficiency of the total surfactant is also increased in the example shown in FIG. 4, while the temperature situation remains virtually unaltered. Lamellar phases are not observed.

In FIG. 5, the curves shift isothermally with an increase in the efficiency and avoidance of lamellar phases. The diamonds depict the system with P5/3. The gray circles depict the system with P5/2.

In FIG. 6, the same behavior can be observed as in FIG. 5.

A considerable increase in efficiency can be likewise observed in FIGS. 7 and 8. Moreover, no lamellar phases occur in the experiments shown in FIGS. 7 and 8. In FIG. 7, the gray dots stand for PI5/PEO15 and the triangles for P5/15.

Whereas FIGS. 2 through 8 document the increase in efficiency by the non-ionic surfactant $C_{10}E_4$ resulting from the addition of block copolymers, FIG. 9 shows the increase in efficiency in an anionic surfactant system consisting of (water+NaCl) and n-decane-AOT-P5/5.

In order to document the increase in efficiency of the block copolymers for another surfactant class, FIG. 10 shows a section through a phase tetrahedron in the system consisting of water and n-octane-octanol-$C_8G_1$-P5/5 in which the ratio of water to n-octanol is 1:1. In this case, the phase behavior is not determined by the temperature but rather by the addition of a co-surfactant (octanol). Here, too, the monophase area shifts—as a result of the addition of block copolymers—to much smaller surfactant concentrations and also to smaller concentrations of co-surfactant.

In the form of an overview, FIG. 11 documents the very marked increase—according to the invention—in the efficiency of the block copolymer admixtures. The total surfactant concentrations at the intersection $\overline{\gamma}$ are plotted as a function of the addition $\delta$ of the block copolymer.

In contrast to conventional surfactant mixtures, with the block copolymers, even a very small addition $\delta$ already leads to a more marked drop in $\overline{\gamma}$ and thus to a greater increase in efficiency.

The value of the oil-water interfacial surface tension minimum correlates with the efficiency of the surfactant mixture whereby, for example, the lowest possible interfacial sur-face tension is desired for the washing process.

FIG. 12 presents the interfacial surface tension as a function of the temperature for the system consisting of water and n-decane-$C_{10}E_4$-P5/5. Already at a $\delta$ of 0.05, the addition of the block copolymer causes the interfacial surface tension minimum value to drop by a factor of five.

An increase in efficiency can be likewise observed in FIG. 13. Moreover, no lamellar phases occur in these experiments.

The measurements shown in FIG. 14 were carried out in cyclohexane, since cyclo-alkanes provide the best conditions for the solubility of polystyrene within the alkane group. Besides, $C_8E_4$ was used as the surfactant component in order to obtain a similar initial efficiency in spite of the changed nonpolar component cyclohexane. Here, too, lamellar phases are suppressed.

By means of the AB block copolymers employed according to the invention, it is possible to lower the interfacial surface tension of surfactants such as, for instance, anionic, cationic or non-ionic surfactants, sugar surfactants or industrial surfactants. The occurrence of lamellar mesophases is suppressed. The temperature behavior of microemulsions remains unaltered, that is to say, the situation of the monophase area in terms of the temperature in the phase diagram is not influenced by the addition of the additives employed according to the invention. For this reason, it is not necessary to change the formulation of a detergent in order to bring about a constant position of the monophase area with respect to the temperature in the monophase diagram.

It is not only in detergents that the AB block copolymers according to the invention can be used; they can also be employed with the same effect, for instance, as additives in food products or cosmetics as well as in all industrial or technical applications involving microemulsions and emulsions, for example, for use in oil extraction, soil clean-up operations as well as for use, for example, as a reaction medium.

The microemulsions prepared by means of the addition according to the invention of the AB block copolymers have emulsified liquid volumes whose size corresponds to that of emulsions.

The effects according to the invention can be achieved by any combination of a surfactant with the AB block copolymer in a system to be emulsified Therefore, the invention encompasses a surfactant to which an AB block copolymer according to the invention has been added as well as any system emulsified with it, additionally water and/or oil.

The effects according to the invention are not restricted to emulsions and micro-emulsions; rather they also generally influence the behavior of surfactants in the manner described.

What is claimed is:

1. An emulsion which comprises water, oil and an additive which comprises an AB block copolymer having a water-soluble block A and a water-insoluble block B and wherein said AB block copolymer has a structure according to the pattern ABA or BAB.

2. A method for suppressing lamellar phases in a water-oil-surfactant mixture which comprises admixing an additive which comprises an AB block copolymer having a water-soluble block A and a water-insoluble block B to the water-oil surfactant mixture.

3. A method for stabilizing the temperature situation of the monophase area for water-oil-surfactant mixture which comprises admixing an additive which comprises an AB block copolymer having a water-soluble block A and a water-insoluble block B to the water-oil-surfactant mixture.

4. A method for increasing the structural size of emulsified liquid particles in a microemulsion which comprises admixing admixing an additive which comprises an AB block copolymer having a water-soluble block A and a water-insoluble block B to the microemulsion.

5. A method for reducing the interfacial surface tension of the emulsion as claimed in claim 2, wherein the emulsion is an oil-water mixture containing surfactants, which comprises admixing the additive to a water-oil-surfactant mixture.

6. The method according to claim 2, wherein said block B is soluble in oil and is soluble in aliphatic hydrocarbons.

7. The method according to claim 2, wherein the block A polymer has a molecular weight between 500 u and 60,000 u.

8. The method according to claim 2, wherein the block B polymer has a molecular weight between 500 u and 60,000 u.

9. The method according to claim 2, wherein the block A polymer is a polyethylene oxide (PEO).

10. The method according to claim 2, wherein the block B polymer is a polydiene or an at least partially hydrated polydiene.

11. The method according to claim 2, wherein said AB block copolymer has side chains in block B which comprise at least one component from the group consisting of methyl, ethyl, phenyl and vinyl.

12. The emulsion according to claim 1, wherein said block A has a molecular weight between 500 u and 60,000 u.

13. The emulsion according to claim 1, herein said block B has a molecular weight between 500 u and 60,000 u.

14. The emulsion according to claim 1, wherein said AB block copolymer has a polyethylene oxide (PEO) as block A.

15. The emulsion according to claim 1, wherein said AB block copolymer has a polydiene or an at least partially hydrated polydiene as block B.

16. The emulsion according to claim 1, wherein said AB block copolymer has side chains in block B which comprise at least one component from the group consisting of methyl, ethyl, phenyl and vinyl.

17. A surfactant mixture which comprises a surfactant and the emulsion as claimed in claim 1.

* * * * *

UNITED STATES PATENT AND TRADEMARK OFFICE

CERTIFICATE OF CORRECTION

PATENT NO. : 6,677,293 B1
DATED : January 13, 2004
INVENTOR(S) : Jürgen Allgaier et al.

It is certified that error appears in the above-identified patent and that said Letters Patent is hereby corrected as shown below:

Column 8,
Line 18, “herein” should read -- wherein --.

Signed and Sealed this

Thirteenth Day of April, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,677,293 B1
DATED : January 13, 2004
INVENTOR(S) : Jürgen Allgaier et al.

It is certified that error appears in the above-identified patent and that said Letters Patent is hereby corrected as shown below:

Title page,
Item [75], Inventors, the following inventor should be added -- Reinhard Strey, Cologne, (DE) --

Signed and Sealed this

Fifteenth Day of June, 2004

JON W. DUDAS
*Acting Director of the United States Patent and Trademark Office*